US012359338B2

(12) United States Patent
Masuda et al.

(10) Patent No.: US 12,359,338 B2
(45) Date of Patent: Jul. 15, 2025

(54) PLATE, APPARATUS FOR PLATING, AND METHOD OF MANUFACTURING PLATE

(71) Applicant: EBARA CORPORATION, Tokyo (JP)

(72) Inventors: Yasuyuki Masuda, Tokyo (JP); Ryosuke Hiwatashi, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 883 days.

(21) Appl. No.: 17/612,098

(22) PCT Filed: Nov. 16, 2020

(86) PCT No.: PCT/JP2020/042582
§ 371 (c)(1),
(2) Date: Nov. 17, 2021

(87) PCT Pub. No.: WO2022/102119
PCT Pub. Date: May 19, 2022

(65) Prior Publication Data

US 2022/0356593 A1 Nov. 10, 2022

(51) Int. Cl.
*C25D 17/00* (2006.01)
*C25D 7/12* (2006.01)
*C25D 21/10* (2006.01)

(52) U.S. Cl.
CPC ..... *C25D 17/001* (2013.01); *C25D 7/12* (2013.01); *C25D 21/10* (2013.01)

(58) Field of Classification Search
None
See application file for complete search history.

(56) References Cited

U.S. PATENT DOCUMENTS

| | | | | |
|---|---|---|---|---|
| 6,261,426 | B1 * | 7/2001 | Uzoh | C25D 5/08 204/224 R |
| 10,876,208 | B2 * | 12/2020 | Chang | C23C 16/4583 |
| 2004/0262150 | A1 * | 12/2004 | Yajima | C25D 7/123 204/224 R |
| 2016/0177466 | A1 | 6/2016 | Kagajawala et al. | |
| 2016/0194776 | A1 * | 7/2016 | Weinhold | C25D 17/06 205/137 |

FOREIGN PATENT DOCUMENTS

| | | | |
|---|---|---|---|
| JP | H11-152600 | A | 6/1999 |
| JP | 2002-054000 | A | 2/2002 |
| JP | 2002-235188 | A | 8/2002 |
| JP | 2004-225129 | A | 8/2004 |

(Continued)

*Primary Examiner* — Alexander W Keeling
(74) *Attorney, Agent, or Firm* — BakerHostetler

(57) ABSTRACT

An object is to enhance the accuracy of porosity and/or the flexibility in adjustment of the porosity in each portion of a plate. There is provided a plate that is placed between a substrate and an anode in a plating tank. The plate comprises a pore forming area in which a plurality of pores are formed, wherein the pore forming area includes a center portion, a middle portion located on an outer side of the center portion, and an outer circumferential portion located on an outer side of the middle portion, the center portion and the outer circumferential portion of the pore forming area have a plurality of oblong pores, and the middle portion of the pore forming area has a plurality of circular pores.

15 Claims, 11 Drawing Sheets

(56) References Cited

FOREIGN PATENT DOCUMENTS

| | | | |
|---|---|---|---|
| JP | 2015-518520 | A | 7/2015 |
| JP | 2016-504500 | A | 2/2016 |
| JP | 2017-222905 | A | 12/2017 |
| JP | 2020-083568 | A | 6/2020 |
| KR | 2005-0025114 | A | 3/2005 |
| WO | WO 2004/009879 | A1 | 1/2004 |
| WO | WO 2013/155229 | A1 | 10/2013 |

* cited by examiner

PLATE, APPARATUS FOR PLATING, AND METHOD OF MANUFACTURING PLATE

TECHNICAL FIELD

The present disclosure relates to a plate, an apparatus for plating, and a method of manufacturing the plate.

BACKGROUND ART

Wiring, bumps (bump electrodes) and the like are conventionally formed on the surface of a substrate such as a semiconductor wafer or a printed circuit board. An electroplating method is known as a method of forming the wiring, the bumps and the like.

In a known configuration of a plating apparatus used in the electroplating method, a plate (ionically resistive element) that has a large number of pores and that is used for adjusting the electric field is placed between a circular substrate such as a wafer and an anode (as described in, for example, Patent Document 1 and Patent Document 2). In order to reduce the adverse effects of the arrangement positions of pores on the distribution of plating film thickness, the arrangement of pores is determined such as to make the distribution density (or the porosity) of the pores formed in the plate, uniform in each area on the plate (as described in Patent Document 3).

RELATED ART DOCUMENT

Patent Document

Patent Document 1: Japanese Unexamined Patent Publication No. 2004-225129

Patent Document 2: International Publication No. 2004/009879

Patent Document 3: Japanese Unexamined Patent Publication No. 2020-083568

SUMMARY OF INVENTION

Technical Problem

In the case of forming pores of an identical size based on a target porosity, an area close to the center of the plate has a low density of pores. This causes an error between the porosity based on the number of actually formed pores and the target porosity. This error is attributed to the requirement for processing the calculated number of pores to an integral number in the process of calculating the number of pores by dividing a theoretical total pore area based on the target porosity by a pore diameter. When an error is equal to or larger than a predetermined value, this error may adversely affect the distribution of the plating film thickness. A method employed to reduce the error of the porosity increases the number of pores. Increasing the number of pores for the purpose of reducing the error may, however, fail to keep an inter-pore space between adjacent pores adjoining to each other in a circumferential direction or in a radial direction. This is likely to cause a problem that it is difficult to machine the pores or a problem that there is no drill having a diameter corresponding to the required pore diameter.

In a configuration of placing a paddle between a wafer and a plate to stir a plating solution, it is required to increase the distance between the wafer and the plate and to increase the dimensions of a plating tank in a horizontal plane direction, in order to ensure the space where the paddle is placed and the space where the paddle is moved. This increases the effect of wraparound of the electric field and increases the film thickness in an edge portion of the substrate. This is likely to adversely affect the in-plane uniformity of the plating film thickness.

By taking into account the problems described above, one object of the present disclosure is to enhance the accuracy of porosity and/or the flexibility in adjustment of the porosity in each area of a plate. Another object of the present disclosure is to improve the in-plane uniformity of plating film thickness.

Solution to Problem

According to one aspect, there is provided a plate that is placed between a substrate and an anode in a plating tank. The plate comprises a pore forming area in which a plurality of pores are formed, wherein the pore forming area includes a center portion, a middle portion located on an outer side of the center portion, and an outer circumferential portion located on an outer side of the middle portion, the center portion and the outer circumferential portion of the pore forming area have a plurality of oblong pores, and the middle portion of the pore forming area has a plurality of circular pores.

DESCRIPTION OF EMBODIMENTS

Figure 1:
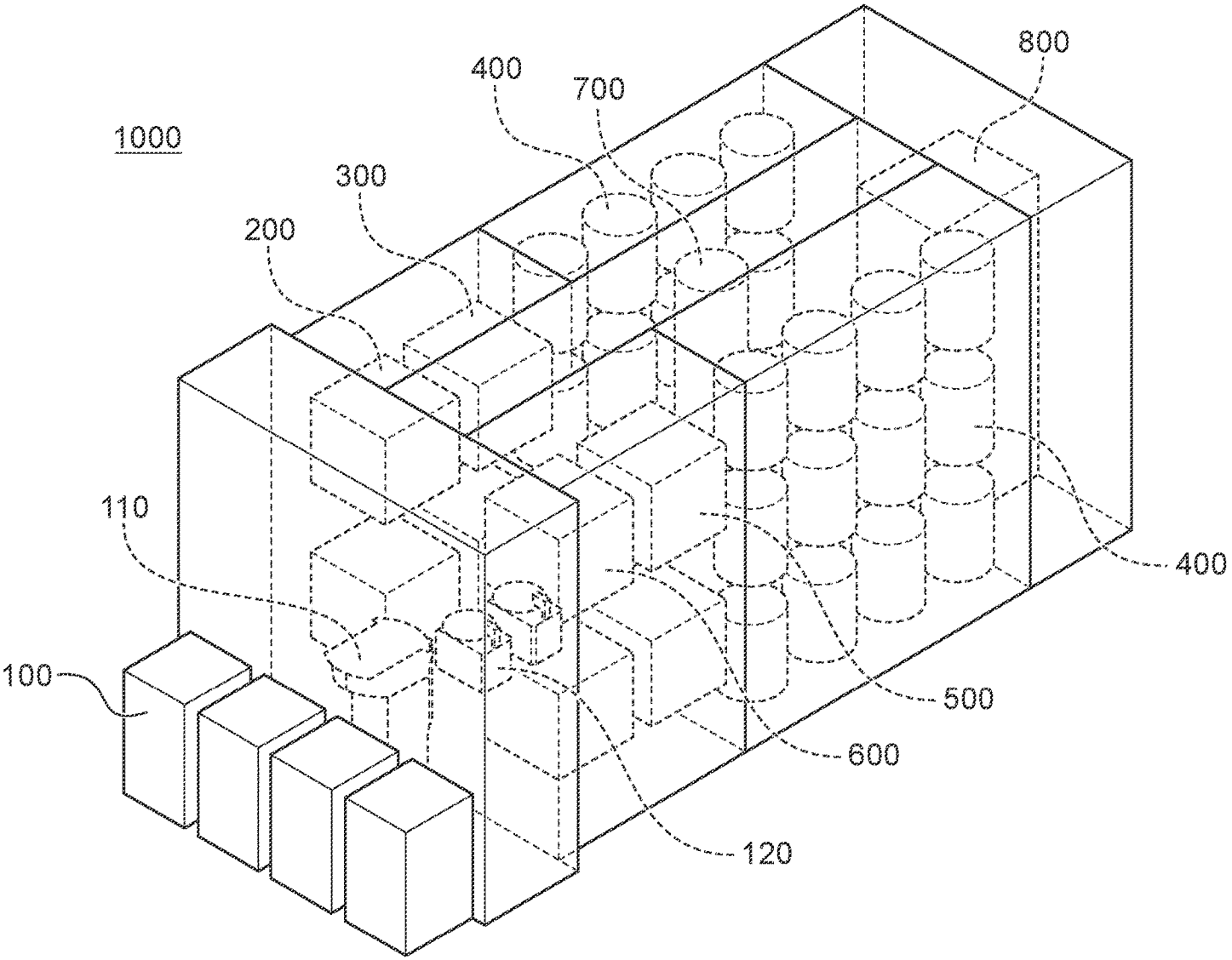
FIG. 1 is a perspective view illustrating the overall configuration of a plating apparatus according to an embodiment.

The following describes embodiments of the present disclosure with reference to drawings. In the drawings described below, identical or equivalent components are expressed by identical reference signs, and duplicated description is omitted.

Figure 2:
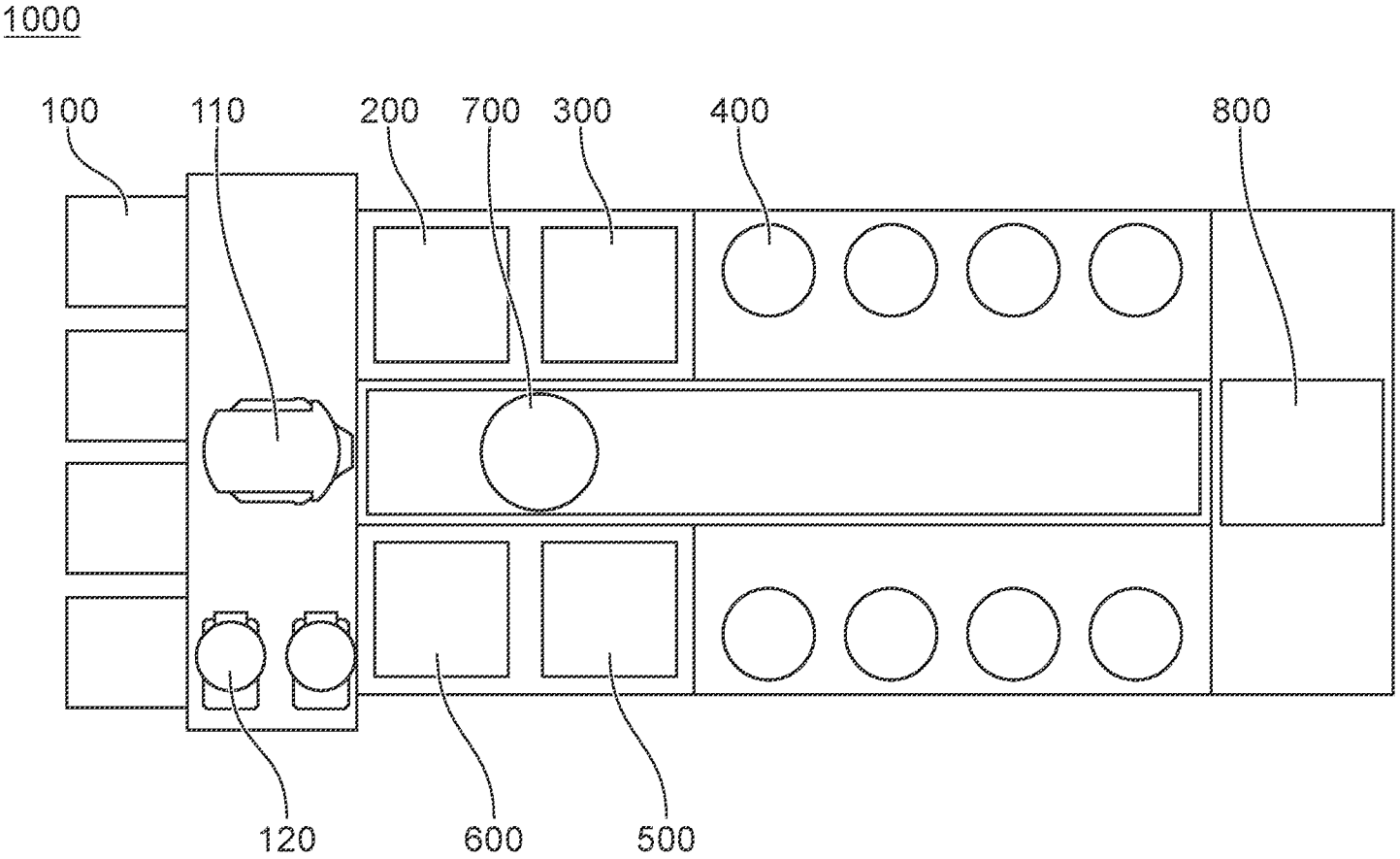
FIG. 2 is a plan view illustrating the overall configuration of the plating apparatus according to the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transfer the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 70) transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Figure 3:
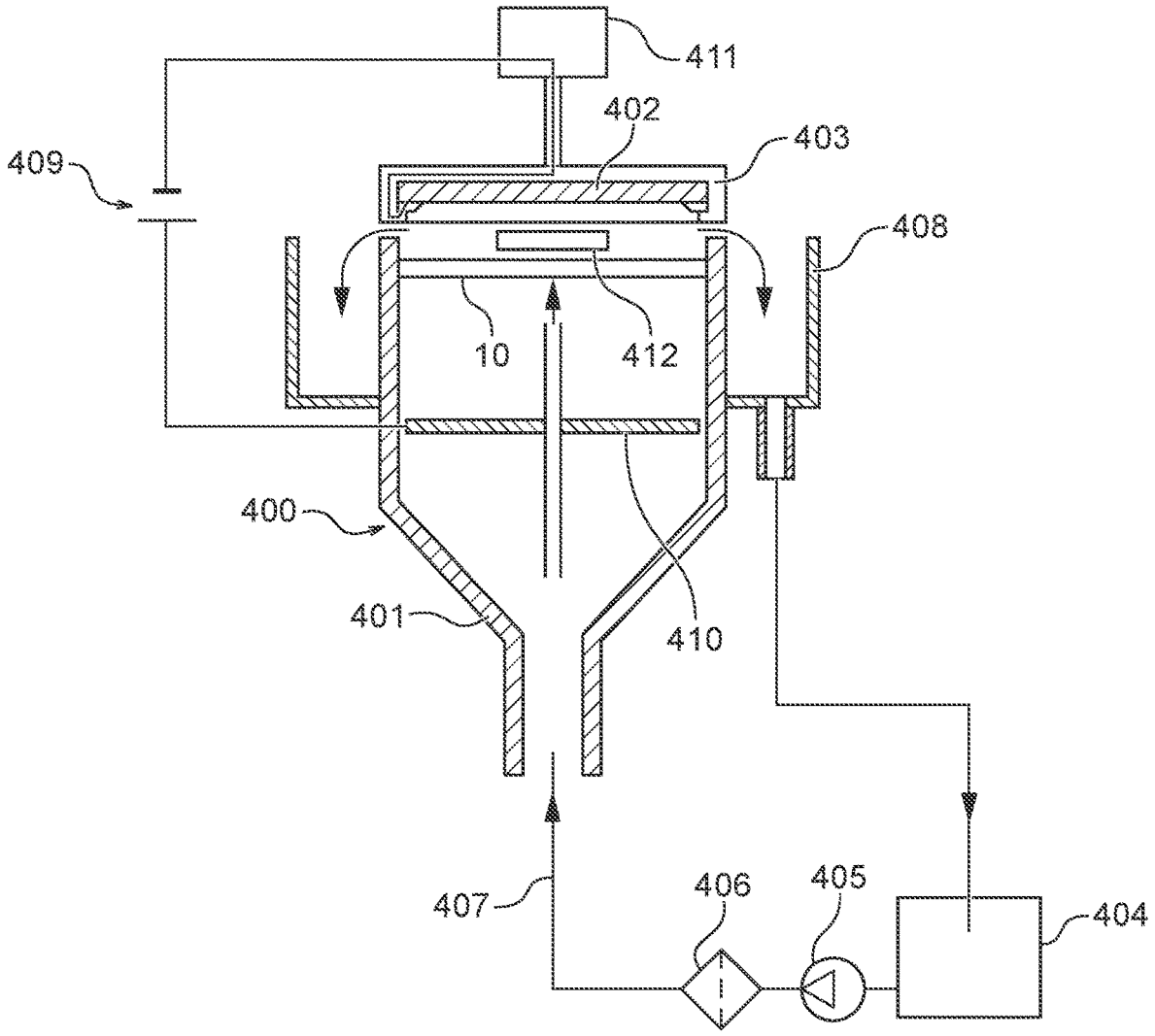
FIG. 3 is a schematic diagram illustrating one example of a plating module provided with a plate according to the embodiment.

FIG. 3 is a schematic diagram illustrating one example of the plating module provided with a plate according to the embodiment. As shown in FIG. 3, the plating module 400 according to the embodiment is a face-down type or cup type plating module. The plating module 400 includes a plating tank 401, a substrate holder 403, and a plating solution storage tank 404. The substrate holder 403 is configured to hold a substrate 402, such as a wafer, in such a manner that a surface to be plated of the substrate 402 faces down. The plating module 400 is provided with a motor 411 configured to rotate the substrate holder 403 in a circumferential direction. An anode 410 is placed in the plating tank 401 to be opposed to the substrate 402.

The plating module 400 also includes a plating solution receiving tank 408. The plating solution in the plating solution storage tank 404 is supplied through a filter 406 and a plating solution supply pipe 407 via a bottom portion of the plating tank 401 into the plating tank 401 by means of a pump 405. The plating solution flowing over from the plating tank 401 is received in the plating solution receiving tank 408 and is returned to the plating solution storage tank 404.

The plating module 400 is also provided with a power supply 409 connected with the substrate 402 and the anode 410. When a predetermined voltage is applied from the power supply 409 to between the substrate 402 and the anode 410 with rotation of the substrate holder 403 by the motor 411, plating current flows between the anode 410 and the substrate 402 to form a plating film on the surface to be plated of the substrate 402.

A plate 10 for adjustment of electric field is placed between the substrate 402 and the anode 410. A paddle 412 is placed between the substrate 402 and the plate 10. The paddle 412 is reciprocated parallel to the substrate 402 by a non-illustrated driving mechanism to stir the plating solution and form a strong current of the plating solution on the surface of the substrate 402.

Figure 4:
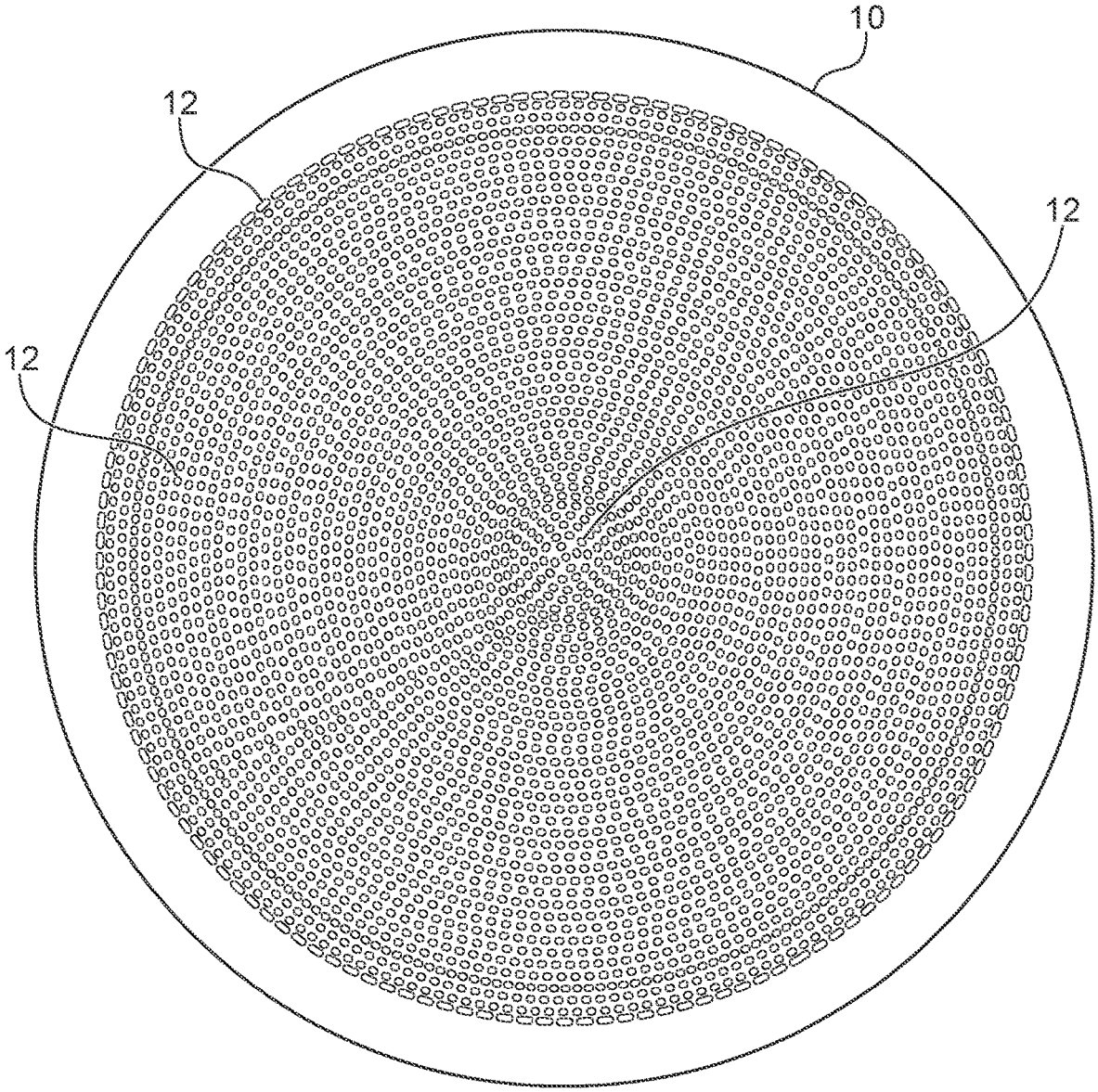
FIG. 4 is a front view illustrating a plate.

FIG. 4 is a front view illustrating the plate 10. As shown in FIG. 4, the plate 10 has a plurality of pores 12 in a circular (perfect circular) shape or in an oblong shape. The pores 12 are formed to pass through between a front face and a rear face of the plate 10 and to form a pathway that allows for passage of the plating solution and ions included in the plating solution.

In the plate 10 according to this embodiment, the plurality of pores 12 are arranged on a plurality of (for example, three or more) virtual reference circles that are concentric relative to the center of the plate 10 and that have different diameters. In other words, the plurality of pores 12 are arranged to be dispersive in a radial direction of the plate 10. Furthermore, in the plate 10, it is preferable that there is a fixed difference between the diameter of any arbitrary reference circle and the diameter of an adjacent reference circle adjoining to this arbitrary reference circle. In other words, it is preferable that the pores 12 are arranged at equal intervals in the radial direction. This configuration enables the pores 12 to be arranged in a more dispersive manner along the radial direction of the reference circles. In the plate 10, it is also preferable that the plurality of pores 12 are arranged at equal intervals in a circumferential direction on the reference circles. This configuration enables the pores 12 to be arranged in a dispersive manner along the circumferential direction of the reference circles. The term "equal intervals" herein is not limited to mathematically strict equal intervals but may include intervals with a slight difference due to an error of machining or the like. An overall outline of the plurality of pores 12 (an outer shape of a pore forming area, an envelope encircling multiple pores 12 located on an outermost side) is in a circular shape in the illustrated example of FIG. 4 but may be in any shape other than the circular shape. The pore forming area herein is an inner region of an envelope encircling multiple pores 12 located at farthermost positions from the center of the plate 12.

In the illustrated example of FIG. 4, the pores 12 in a center portion and an outer circumferential portion of the pore forming area of the plate 10 are oblong pores, and the pores 12 in a middle portion between the center portion and the outer circumferential portion are circular pores. The pores 12 in at least one of the center portion and the outer circumferential portion may be oblong pores. The pores 12 on one or multiple reference circles including an innermost reference circle in the center portion may be oblong pores, and the pores 12 on one or multiple reference circles including an outermost reference circle in the outer circumferential portion may be oblong pores. According to the embodiment, the pores 12 are formed in an oblong shape in a portion where the pores 12 in a circular shape have difficulty in achieving a porosity close to a target porosity P (described later). This configuration achieves the porosity close to or equal to the target porosity P in each portion of the pore forming area.

Figure 5A:
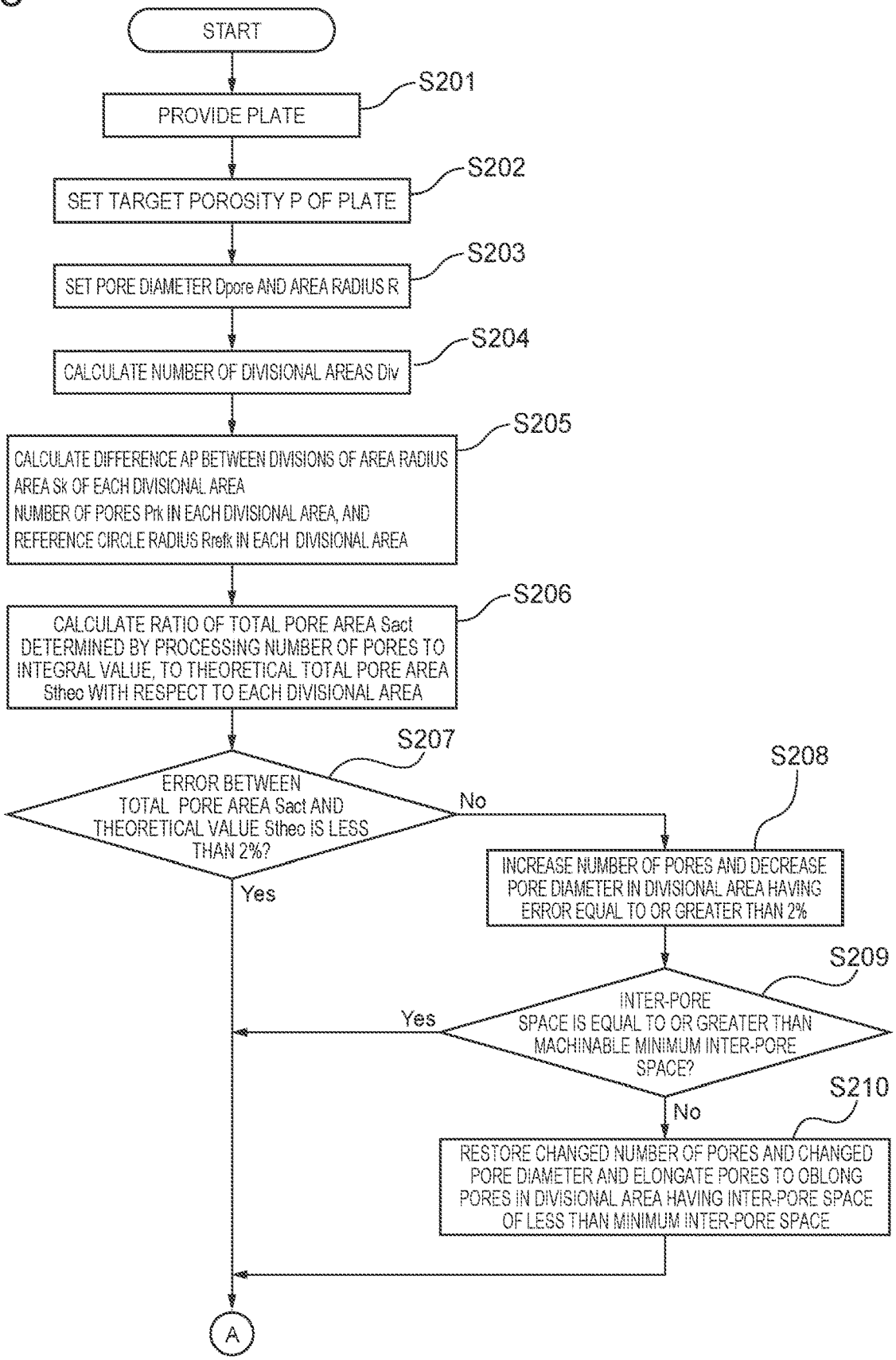
FIG. 5A is a flowchart showing a manufacturing process of the plate.
Figure 5B:
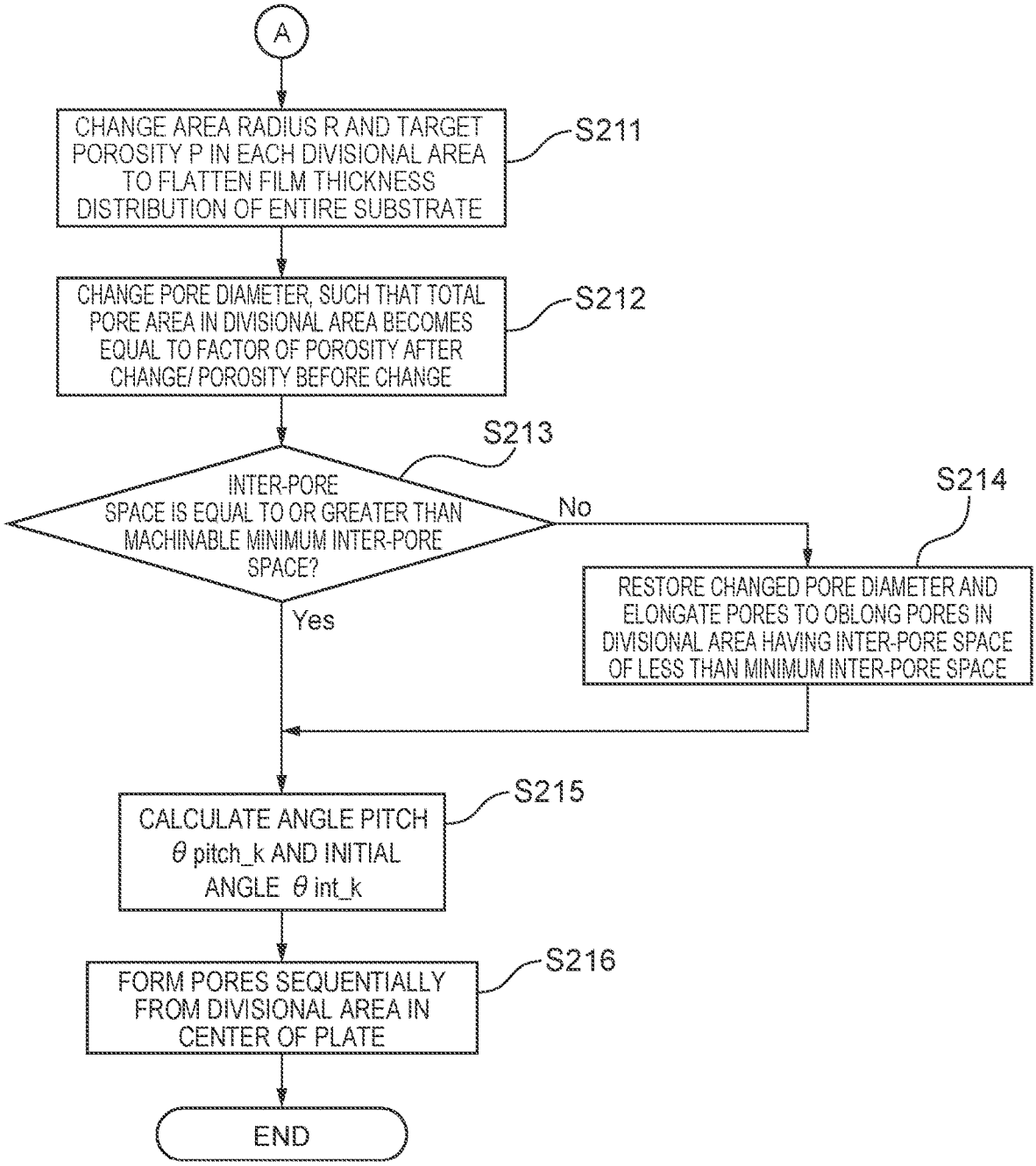
FIG. 5B is a flowchart showing the manufacturing process of the plate.

The following describes a method of manufacturing the plate 10. FIG. 5A and FIG. 5B are flowcharts showing a manufacturing process of the plate 10. The manufacturing process first provides a plate 10 without pores 12 as a material of the plate 10 (step S201), the plate 10 without pores 12 is made of an electrically insulating material, for example, PVC (polyvinyl chloride).

The manufacturing process subsequently sets a target porosity P of the plate 10 (step S202). The porosity herein may be expressed by "the total area of the plurality of pores 12/the area of a region where the pores 12 are formed (area size)". In the description below, the total area of the plurality of pores 12 may be referred to as the "total pore area." The area size may be referred to as the "pore forming area size." The pore forming area corresponds to the region where the pores 12 are formed in FIG. 4. The target porosity P herein is a porosity as a target used in the manufacturing process of the plate 10. An appropriate numerical value may be obtained in advance as the target porosity P by test or by simulation. More specifically, it is known that there is an appropriate value for the target porosity P according to the distance between the substrate 402 and the plate 10. The appropriate value of the target porosity P is thus obtained by test or by simulation, based on the distance between the substrate 402 and the plate 10 in the plating module 400 shown in FIG. 3.

The manufacturing process subsequently sets a pore diameter $D_{pore}$ and an area radius R of the pores 12 formed in the plate 10 (step S203). The pore diameter $D_{pore}$ may be set arbitrarily according to the rules of thumb or the like as long as the diameter of the pores is a machinable size. The area radius R is a radius of a circular region where the pores 12 are formed on the plate (pore forming area) and may be set arbitrarily, for example, based on the size of the plating tank 401, the substrate 402, and/or the anode 410 shown in FIG. 3. In the description of the embodiment, terms simply referring to "radial direction" and "circumferential direction" respectively mean "radial direction of the area radius R" and "circumferential direction of the area radius R".

Figure 6:
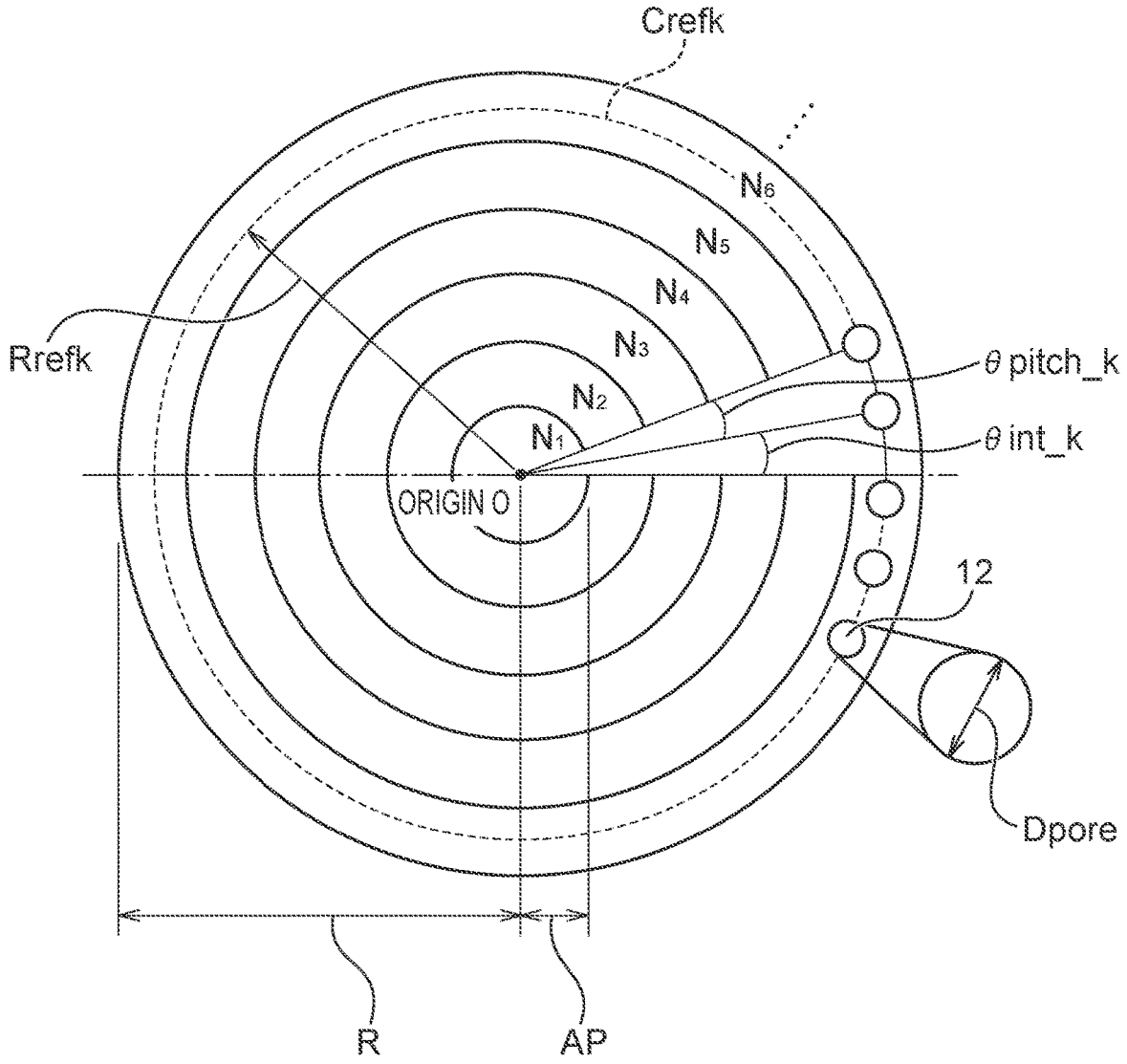
FIG. 6 is a schematic diagram illustrating a region which is defined by an area radius of the plate and in which pores are formed.

After setting the target porosity P, the pore diameter $D_{pore}$, and the area radius R, the manufacturing process calculates the number of divisional areas Div (step S204). The divisional areas herein are ring-shaped areas which have a fixed width and in which a plurality of reference circles that are concentrical and that have different diameters are respectively placed, as shown in FIG. 6. Accordingly, determining the number of divisional areas Div determines the degree of dispersion of the pores 12 arranged in a direction of the area radius R.

FIG. 6 is a schematic diagram illustrating a region which is defined by the area radius R of the plate 10 and in which the pores 12 are formed. In the illustrated example, the number of divisional areas Div is six, and a divisional area $N_1$ to a divisional area $N_6$ are shown sequentially outward from a center side of the area radius R. A reference circle $Cref_k$ is a circle that shows the positions where the plurality of pores 12 (centers of the pores 12) are located and that is formed by connecting center points in the width of each divisional area $N_k$. According to the embodiment, "k" is a variable indicating a divisional area number (1 to 6 in the illustrated example). The divisional area $N_1$ includes the center of the area radius R and is in a circular shape different from the other divisional areas $N_2$ to $N_6$. A reference circle radius $Rref_k$ is a radius of each reference circle $Cref_k$ relative to the center of the area radius R.

As shown in FIG. 6, the area radius R corresponds to an outer radius of a largest divisional area $N_k$ (the divisional area $N_6$ in the illustrated example). A difference AP between divisions of the area radius R is a difference in the radial direction between each divisional area $N_k$ and an adjacent divisional area $N_{k+1}$ (or an adjacent divisional area $N_{k-1}$). In other words, the difference AP between the divisions of the area radius R corresponds to a width of each divisional area $N_k$.

Each pore 12 of the plate 10 has the pore diameter $D_{pore}$. A pore area $S_{pore}$ of each pore 12 is expressed as π*(pore diameter $D_{pore}$/2)^2. Each pore 12 on the reference circle $Cref_k$ in each divisional area $N_k$ is placed at a position having an initial angle $\theta_{int_k}$ from any radius and is arranged to be away from each adjacent pore 12 at an angle pitch $\theta_{pitch_k}$. The details of the initial angle $\theta_{int_k}$ and the angle pitch $\theta_{pitch_k}$ will be described later.

Figure 7:
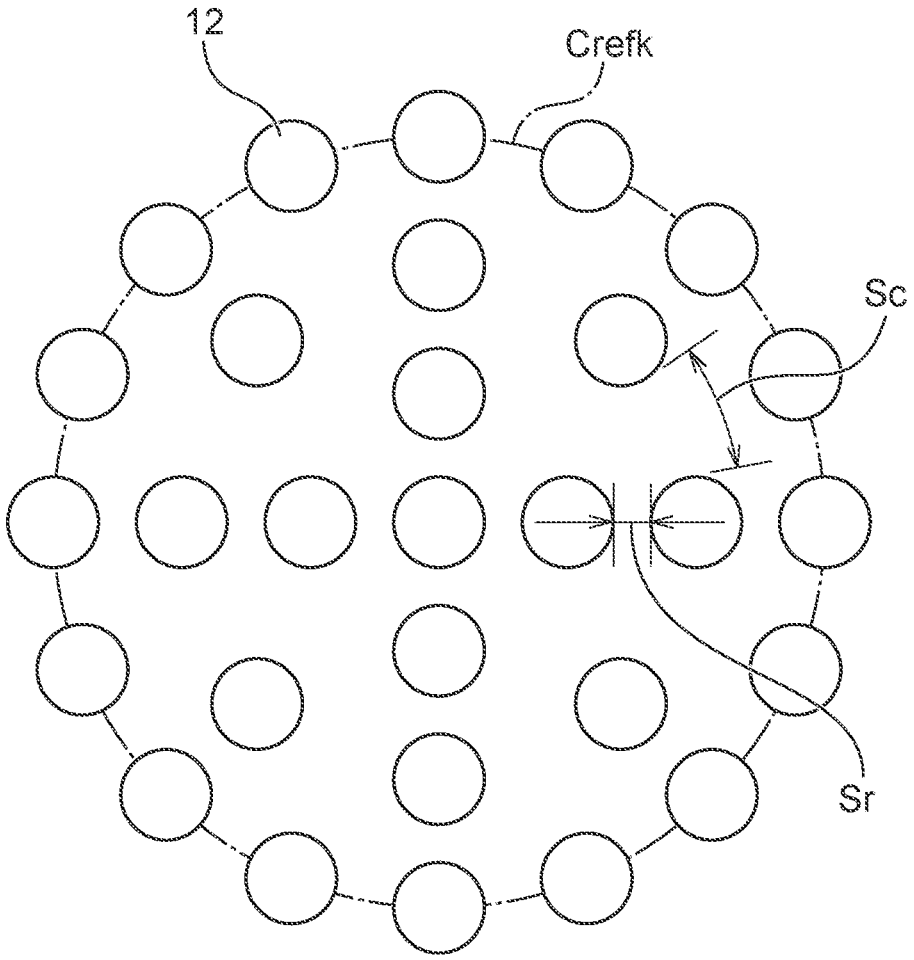
FIG. 7 is a schematic diagram illustrating a relationship between an inter-pore space in a circumferential direction and an inter-pore space in a radial direction.

FIG. 7 is a schematic diagram illustrating a relationship between a space in a circumferential direction and a space in a radial direction of the plurality of pores 12. As shown in FIG. 7, the space Sc in the circumferential direction of a plurality of pores 12 corresponds to a separation distance in the circumferential direction between the plurality of pores 12 placed on the reference circle $Cref_k$ in each divisional area $N_k$. The space Sr in the radial direction of a plurality of pores 12 corresponds to a separation distance in the direction of the area radius R between the plurality of pores 12 placed on the reference circle $Cref_k$ in each divisional area $N_k$. In order to arrange the plurality of pores 12 in an evenly dispersive manner in the plate 10, it is preferable that the space Sc in the circumferential direction and the space Sr in the radial direction of the plurality of pores 12 placed on the reference circle $Cref_k$ in each divisional area $N_k$ are equal to each other or are approximate to each other.

On the assumption that the space Sc in the circumferential direction and the space Sr in the radial direction of the plurality of pores 12 are equal to each other, the number of divisional areas Div is calculated from the target porosity P, the pore diameter $D_{pore}$, and the area radius R. More specifically, the number of divisional areas Div is expressed by an expression given below:

Number of divisional areas Div=ROUND[SQRT {(4*area radius $R$^2*target porosity $P$)/(pore diameter $D_{pore}$^2*π)}]

This expression calculates the number of divisional areas Div which provide the space Sc in the circumferential direction and the space Sr in the radial direction approximate to each other. According to this embodiment, the number of divisional areas Div is processed to an integral number by using the ROUND function to round off. This method is, however, not essential, but any other function may be employed to process the result of calculation to an integral number.

The manufacturing process subsequently calculates the difference AP between the divisions of the area radius R, each divisional area size $S_k$, the number of pores $Pr_k$ in each divisional area, and the reference circle radius $Rref_k$ in each divisional area (step S205). According to the embodiment, the respective divisional areas $N_k$ have an identical width, which is equal to the difference AP. Accordingly, the difference AP is expressed as (area radius R/number of divisional areas Div) and is calculated from the area radius R and the number of divisional areas Div.

Each divisional area size $S_k$ is calculated when the difference AP is determined. More specifically, the divisional area size $S_k$ is expressed as (difference AP*k)^2*π−(difference AP*(k−1))^2*π and is calculated from the difference AP.

The number of pores $Pr_k$ in each divisional area is calculated from each divisional area size $S_k$, the target porosity P and the pore diameter $D_{pore}$. More specifically, the number of pores $Pr_k$ in each divisional area is expressed by an expression given below.

Number of pores $Pr_k$ in each divisional area=ROUND((each divisional area size $S_k$*target porosity $P$)/pore area $S_{pore}$)

According to this embodiment, the number of pores $Pr_k$ in each divisional area is processed to an integral number by using the ROUND function to round off. This method is, however, not essential, but any other function may be employed to process the result of calculation to an integral number.

The reference circle radius $Rref_k$ is calculated from the difference AP between the divisions of the area radius R. More specifically, the reference circle radius $Rref_k$ is expressed as (difference AP*(k−0.5)).

As described above, the number of pores $Pr_k$, i.e., the number of pores 12 formed in each divisional area $N_k$, is calculated by the processing of step S205. The calculated number of pores $Pr_k$ in the divisional area $N_k$ is, however, processed to an integral number in the course of calculation. Each divisional area size $S_k$ used for calculation of the number of pores $Pr_k$ in each divisional area $N_k$ is derived from the number of divisional areas Div that is also processed to an integral number. Accordingly, there may be a difference between a total pore area $S_{act}$ calculated from the number of pores $Pr_k$ in each divisional area (=number of pores $Pr_k$ in each divisional area*pore area $S_{pore}$: corresponding to the actual porosity in each divisional area) and a theoretical total pore area $S_{theo}$ that is a target value calculated from the target porosity P (=target porosity P*divisional area size $S_k$: corresponding to the target porosity in each divisional area). An error is thus calculated between the total pore area $S_{act}$ calculated based on the number of pores in one divisional area $N_k$ (total area of the pores 12) and the theoretical total pore area $S_{theo}$ calculated based on the target porosity P in the same divisional area $N_k$ (theoretical total area of the pores 12). In particular, according to the embodiment, the manufacturing process calculates a ratio of the total pore area $S_{act}$ calculated from the number of pores $Pr_k$ that is processed to an integral number, to the theoretical total pore area $S_{theo}$, with respect to each divisional area $N_k$ (step S206). More specifically, this ratio is expressed as (total pore area $S_{act}$/theoretical total pore area $S_{theo}$*100).

The manufacturing process subsequently determines whether the error between the total pore area $S_{act}$ and the theoretical total pore area $S_{theo}$ calculated with respect to each divisional area is less than a predetermined value and, when the error is equal to or greater than the predetermined value, increases the number of pores $Pr_k$, i.e., the number of pores 12 in the divisional area $N_k$ and decreases the pore diameter $D_{pore}$. In particular, according to the embodiment, when the error between the theoretical total pore area $S_{theo}$ and the total pore area $S_{act}$ is less than 2% (step S207: YES), the manufacturing process proceeds to the processing of step S211 (shown in FIG. 5B). When the error between the theoretical total pore area $S_{theo}$ and the total pore area Sn is equal to or greater than 2% (step S207: NO), on the other hand, the manufacturing process increases the number of pores $Pr_k$ in the divisional area $N_k$ by 2.25 times and decreases the pore diameter $D_{pore}$ by two thirds (⅔) (step S208). When the value obtained by increasing the number of pores $Pr_k$ by 2.25 times is a decimal, the value may be processed to an integral number by using an arbitrary function. This process decreases the size of but increases the number of the pores 12 in the divisional area $N_k$ and thereby causes the total pore area $S_{act}$ (the actual porosity based on the number of pores $Pr_k$*pore diameter $D_{pore}$) to become closer to the theoretical total pore area $S_{theo}$ (the target porosity). The increasing rate of the number of pores $Pr_k$ and the decreasing rate of the pore diameter $D_{pore}$ may be determined arbitrarily in such a range that the error of the total pore area $S_{act}$ calculated from the number of pores $Pr_k$ and the pore diameter $D_{pore}$ after the change becomes less than 2%.

The manufacturing process subsequently calculates inter-pore spaces Sc and Sr from the number of pores $Pr_k$ and the pore diameter $D_{pore}$ after the change and determines whether the inter-pore space Sc and the inter-pore space Sr are equal to or larger than a machinable minimum inter-pore space Ss (step S209). The processing of step S209 is performed with respect to each divisional area.

Figure 8:
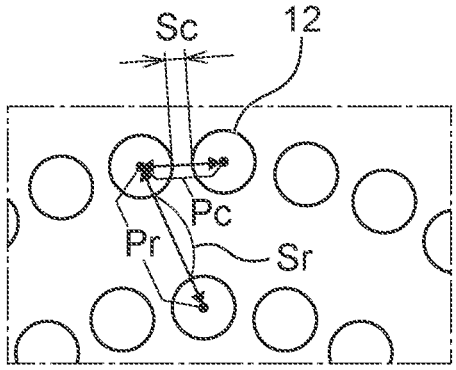
FIG. 8 is a schematic diagram illustrating a method of calculating the inter-pore space in the circumferential direction and the inter-pore space in the radial direction.

In FIG. 8, it is assumed that a plurality of pores 12 on an outer side are located on a reference circle $Cr_k$ (having a radius $Rref_k$) and that a plurality of pores 12 on an inner side are located on a reference circle $Cr_{k-1}$ (having a radius $Rref_{k-1}$). The inter-pore space Sc is a space between adjacent pores 12 in the circumferential direction and is determined by subtracting the sum of radii of the adjacent pores 12 adjoining to each other in the circumferential direction on the reference circle $Cr_k$ (having the radius of $Rref_k$) from the pitch Pc in the circumferential direction that is a distance between the centers of the adjacent pores 12 adjoining to each other in the circumferential direction as shown in FIG. 8. More specifically, the inter-pore space Sc is calculated by an expression given below:

$$\text{Inter-pore space } Sc=2\pi*Rref_k/Pr_k-D_{pore} \quad \text{(Expression 1)}$$

The inter-pore space Sr is a space between adjacent pores 12 in the radial direction and is determined by subtracting the sum of radii of the adjacent pores 12 adjoining to each other in the radial direction from the pitch Pr in the radial direction that is a distance between the centers of the adjacent pores 12 adjoining to each other in the radial direction as shown in FIG. 8. More specifically, the inter-pore space Sr is calculated by an expression given below:

$$\text{Inter-pore space } Sr=(Rref_k-Rref_{k-1})-D_{pore} \quad \text{(Expression 2)}$$

The manufacturing process then determines whether both the calculated inter-pore space Sc and the calculated inter-pore space Sr are equal to or larger than the machinable minimum inter-pore space Ss, i.e., whether the calculated inter-pore space Sc and the calculated inter-pore space Sr satisfy the following conditions:

$$Sc \geq Ss, \text{ and } Sr \geq Ss \quad \text{(Expression 3)}$$

When both the calculated inter-pore space Sc and the calculated inter-pore space Sr are equal to or larger than the minimum inter-pore space Ss, the manufacturing process proceeds to step S211 (shown in FIG. 5B).

Figure 9:
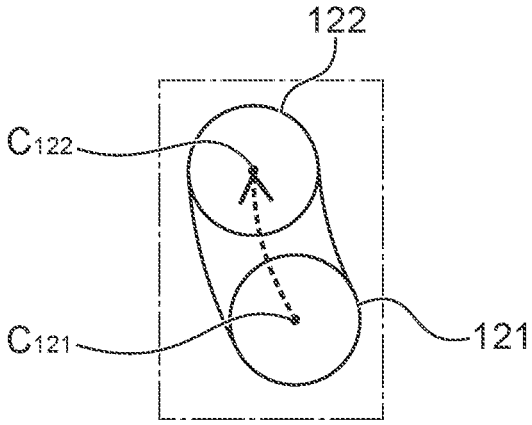
FIG. 9 is a schematic diagram illustrating a method of machining an oblong pore.
Figure 10:
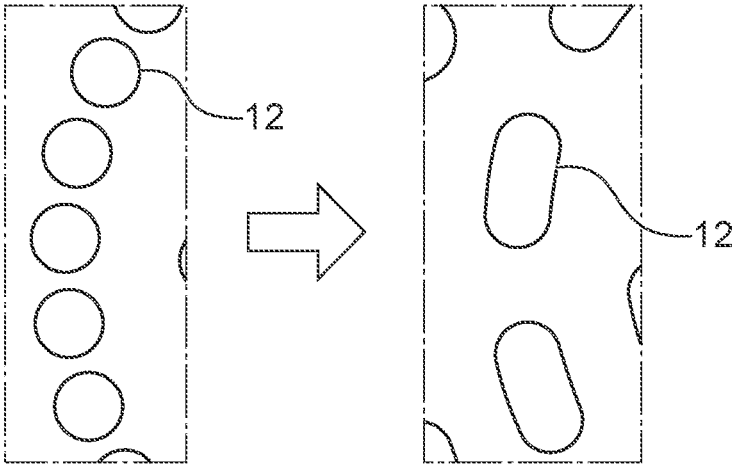
FIG. 10 is a schematic diagram illustrating a relationship between circular pores and oblong pores.

When either the inter-pore space Sc or the inter-pore space Sr is less than the minimum inter-pore space Ss, the manufacturing process elongates the pores 12 in the divisional area $N_k$ (step S210). More specifically, the manufacturing process restores the number of pores $Pr_k$ and the pore diameter $D_{pore}$ changed at step S208 and elongates the circular pores 12 along the circumferential direction of the reference circle to oblong pores 12 as shown in FIG. 9 and FIG. 10. For example, in the case of milling, the length/area of the oblong pore is controlled by adjusting the length of trajectory of end milling. In FIG. 9, a reference sign 121 indicates a circular portion corresponding to the shape of an end mill tip at a start point of end milling, and a reference sign 122 indicates a circular portion corresponding to the shape of the end mill tip at an end point of end milling. A circumferential portion connecting the circular portion 121 with the circular portion 122 (connecting respective centers $C_{121}$ and $C_{122}$ of the circular portions with each other) indicates the trajectory of the end mill.

Figure 11:
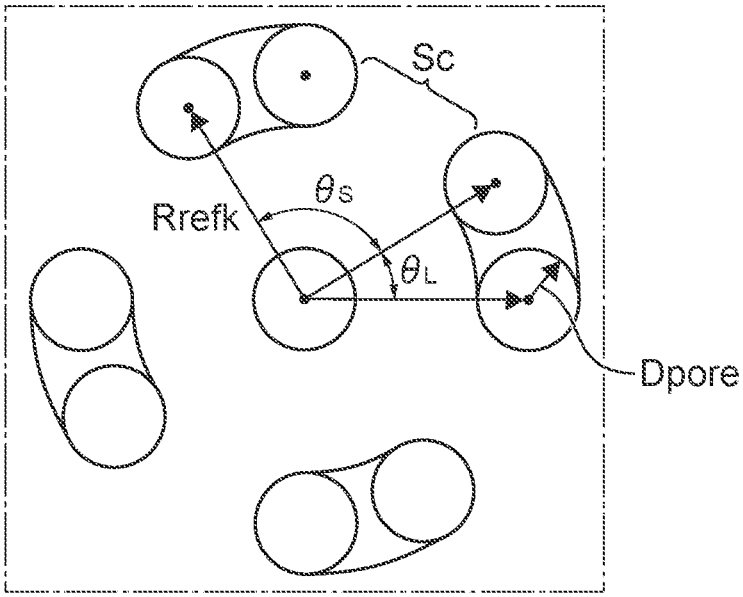
FIG. 11 is a schematic diagram illustrating a method of arranging oblong pores.

It is preferable to select the number of oblong pores 12 such as to form oblong pores as many as possible with keeping the minimum inter-pore space Sc, in order to prevent the pattern of the pores from being observed as a film thickness distribution on the wafer (in order to prevent the oblong pores from being excessively long). According to the embodiment, the manufacturing process determines the number of pores $Pr_k$ as the number of oblong pores 12 and a center angle $\theta_L$ of the reference circle corresponding to the length of the trajectory of the oblong pore 12 (as shown in FIG. 11), such as to maximize the number of pores with keeping the minimum inter-pore space Sc. A method of calculating the number of pores $Pr_k$ and the center angle $\theta_L$ is described below with reference to FIG. 11 and FIG. 12.

Elongation of the pores at step S210 is performed with respect to the divisional area having the error of the total pore area equal to or greater than the predetermined value (step S207: NO). Accordingly, the shape of the pores 12 is changed from the circular shape to the oblong shape in a center portion close to the center of the pore forming area having the less number of pores.

As shown in FIG. 11, the sum of the inter-pore spaces Sc between adjacent oblong pores 12 on the reference circle $Cref_k$ is calculated from subtracting the sum of the lengths of the oblong pores 12 from the length of the circumference of the reference circle $Cref_k$ where the oblong pores 12 are placed. More specifically, the sum of the inter-pore spaces Sc is calculated by an expression given below:

$$\text{Sum of inter-pore spaces } Sc=2\pi*Rref_k-(2\pi*Rref_k*\theta_L/360+D_{pore})*Pr_k \quad \text{(Expression 4)}$$

It is required to satisfy an expression given below, in order to make the inter-pore space Sc equal to or greater than the minimum inter-pore space Ss:

$$2\pi*Rref_k-(2\pi*Rref_k*\theta_L/360+D_{pore})*Pr_k \geq Ss*Pr_k \quad \text{(Expression 5)}$$

In Expression 5, the left side is the sum of the inter-pore spaces Sc on the reference circle $Cref_k$, and the right side is the sum of the minimum inter-pore spaces Ss on the reference circle $Cref_k$. This corresponds to the condition that the inter-pore space Sc is equal to or greater than the minimum inter-pore space Ss.

With a view to causing the porosity in the divisional area $N_k$ where the oblong pores 12 are formed to be equal to the target porosity P, it is further required to satisfy an expression given below, so as to make the total area of the oblong pores 12 (the total pore area $S_{act}$) equal to the theoretical total pore area $S_{theo}$ calculated from the target porosity in the divisional area $N_k$:

$$S_{theo}/Pr_k=\pi(D_{pore}/2)^2+\{(\pi(Rref_k+D_{pore}/2)^2-\pi(Rref_k-D_{pore}/2)^2\}*\theta_L/360 \quad \text{(Expression 6)}$$

Figure 12:
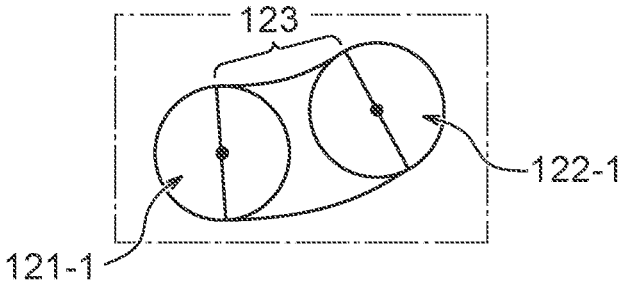
FIG. 12 is a schematic diagram illustrating a method of calculating the area of an oblong pore.

The left side is division of the theoretical total pore area $S_{theo}$, which is calculated by multiplying the target porosity P in the divisional area $N_k$ by the size of the divisional area $N_k$, by the number of pores $Pr_k$ as the oblong pores 12. The right side shows the area of one oblong pore 12 by using the center angle $\theta_L$ of the oblong pore 12. As shown in FIG. 12, $\pi(D_{pore}/2)^2$ shows a total area of semicircles 121-1 and 122-1 at the respective ends of the oblong pore 12, and $\{\pi(r+D_{pore}/2)^2-\pi(r-D_{pore}/2)^2\}*\theta_L/360$ shows an area of an annular portion 123 with exclusion of the semicircles at the respective ends of the oblong pore 12.

The manufacturing process determines the maximum number of oblong pores $Pr_k$ that satisfies Expression 5 by expressing $\theta_L$ using $Pr_k$ according to Expression 6 and substituting this expression into $\theta_L$ in Expression 5, and subsequently determines $\theta_L$ by substituting the determined number of pores $Pr_k$ into Expression 6. Determining the number of pores $Pr_k$ and the center angle $\theta_L$ of the oblong pores 12 as described above enables the total pore area of the oblong pores 12 (the porosity) in the divisional area $N_k$ to be equal to or to be close to the theoretical total pore area $S_{theo}$ as the target (the target porosity P), while keeping the inter-pore space Sc. The oblong pore 12 is formed by elongating the pore 12 in the originally circular shape in the circumferential direction, so that the pore diameter $D_{pore}$ is not changed in the process of elongating the circular pore 12. Accordingly, there is no need to take into account the inter-pore space Sr in the radial direction.

At subsequent step S211, the manufacturing process adjusts the area radius R of the pore forming area and the porosity $P_k$ in each divisional area $N_k$, such as to provide a flat film thickness distribution of the entire substrate according to the results of experiment or simulation. According to the embodiment, the manufacturing process sets the pore diameter $D_{pore}$ to 0 in one or multiple divisional areas $N_k$ including the outermost divisional area $N_k$ without changing the area radius R set at step S203, so as to decrease the radius of a region where the pores are actually formed (actual area radius). This prevents recalculation caused by resetting of the area radius R. The manufacturing process also increases the target porosity P in one or multiple inner divisional areas $N_k$ that are on the inner side of the one or multiple divisional areas $N_k$ where the pore diameter $D_{pore}$ is set to 0.

Figure 13:
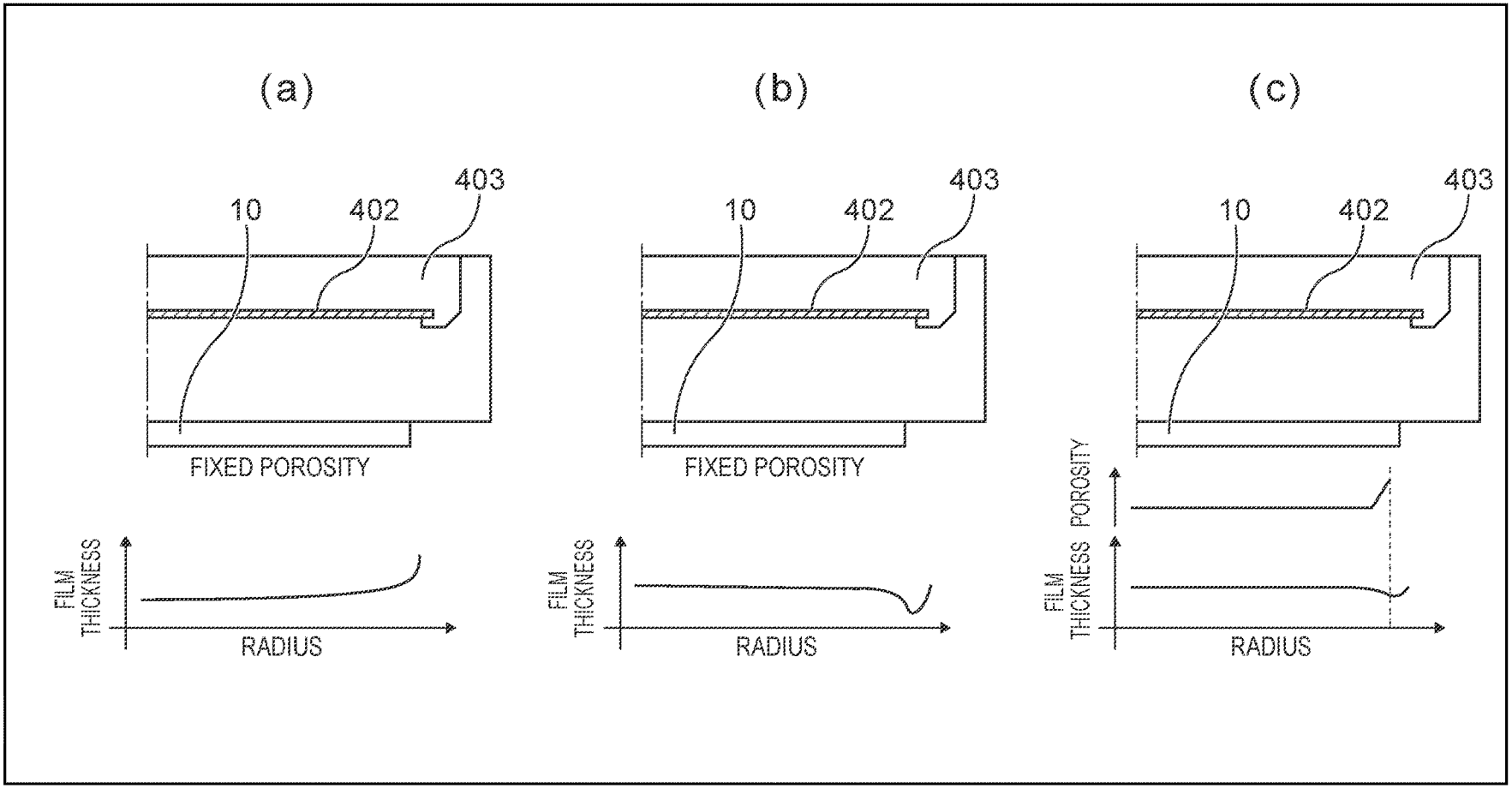
FIG. 13 is schematic diagrams illustrating a method of improving a distribution of plating film thickness.

The outer circumferential portion (edge portion) of the substrate 402 tends to have a large film thickness, due to wraparound of the electric field. Especially, in the case where the paddle 412 is placed between the substrate 402 and the plate 10 as shown in FIG. 3, in order to ensure the space where the paddle 412 is placed and the space where the paddle 412 is moved, it is required to increase the distance between the substrate 402 and the plate 10 and the dimensions of the plating tank 401 in a horizontal plane direction. This enhances the influence of wraparound of the electric field on the outer circumferential portion of the substrate 402 and tends to increase the film thickness in the edge portion of the substrate 402 as shown in FIG. 13(*a*). With a view to reducing such an increase in the film thickness on the outer circumferential portion of the substrate 402, the manufacturing process optimizes (decreases) the area radius R of the pore forming area (as shown in FIG. 13(*b*)) and optimizes (increases) the pore area (porosity $P_k$) in a divisional area $N_k$ corresponding to a portion having a small film thickness (as shown in FIG. 13(*c*)). The paddle 412 is omitted from the illustration of FIG. 13.

More specifically, as shown in FIG. 13(*b*), the manufacturing process decreases the area radius R to weaken the electric field reaching the outer circumferential portion of the substrate 402. Simply decreasing the area radius R, however, causes the outer circumferential portion of the substrate to have a smaller film thickness than that of the center portion of the substrate as shown in FIG. 13(*b*). Accordingly, the manufacturing process increases the porosity (the target porosity P) of an outer circumferential portion in the pore forming area of the plate 10 corresponding to the outer circumferential portion of the substrate 402, so as to increase the film thickness on the outer circumferential portion of the substrate 402 and flatten the film thickness distribution of the entire substrate 402 as shown in FIG. 13(*c*).

After changing the area radius R and the target porosity P, the manufacturing process adjusts the pore diameter $D_{pore}$, such that the total pore area $S_{act}$ $(\pi(D_{pore}/2)^2)*Pr_k$ in each divisional area $N_k$ becomes equal to a factor of the target porosity after the change/the target porosity before the change (step S212). More specifically, in one or multiple inner divisional areas $N_k$ on the inner side of the one or multiple divisional areas $N_k$ having the pore diameter $D_{pore}$ set to 0, the manufacturing process increases the pore diameter $D_{pore}$, such that the total pore area $S_{act}$ $(\pi(D_{pore}/2)^2)*Prk$ in each divisional area $N_k$ becomes equal to a factor of the target porosity after the change/the target porosity before the change. In the illustrated example of FIG. 13, the manufacturing process sets the pore diameter $D_{pore}$ to 0 in one or multiple divisional areas including the outermost divisional area and increases the pore diameter $D_{pore}$ such as to achieve the increased target porosity P in one or multiple inner divisional areas on the inner side of these divisional areas.

The processing of steps S211 and S212 decreases the actual area radius (as shown in FIG. 13(*b*)) and also increases the pore area (porosity $P_k$) in the divisional area $N_k$ corresponding to the portion having the small film thickness (as shown in FIG. 13(*c*)). A modified procedure may add an additional divisional area to outside of the outermost divisional area and increase the actual area radius, in order to further flatten the film thickness distribution according to the substrate. Another modified procedure may increase or decrease the pore area (porosity $P_k$) in each divisional area as needed basis, for example, by decreasing the pore area (porosity $P_k$) in part of the divisional areas or by combination of increasing the pore area (porosity $P_k$) in part of the divisional areas with decreasing the pore area (porosity $P_k$) in another part of the divisional areas.

The manufacturing process subsequently calculates the inter-pore space Sc in the circumferential direction and the inter-pore space Sr in the radial direction by using the pore diameter $D_{pore}$ after the change according to Expression 1 and Expression 2 and determines whether the inter-pore space Sc and the inter-pore space Sr are equal to or larger than the minimum inter-pore space Ss (step S213). When the result of the determination shows that both the inter-pore space Sc and the inter-pore space Sr are equal to or larger than the minimum inter-pore space Ss, the manufacturing process proceeds to step S215.

When either the inter-pore space Sc or the inter-pore space Sr is less than the minimum inter-pore space Ss, the manufacturing process restores the pore diameter $D_{pore}$ changed at step S212 and elongates the pores 12 in a similar manner to the processing of step S210 described above, such as to achieve the target porosity P after the change by the processing of step S211 (step S214). The manufacturing process subsequently proceeds to step S215. Elongation of the pores at step S214 is performed with respect to the divisional area where the target porosity P is changed (at step S211). Accordingly, the pores 12 are changed from the circular shape to the oblong shape in the outer circumferential portion of the pore forming area (one or multiple inner divisional areas on the inner side of the one or multiple divisional areas $N_k$ having the pore diameter $D_{pore}$ set to 0, i.e., one or multiple divisional areas including the outermost divisional area with regard to the actual area radius after the change). The foregoing describes the example of changing the target porosity P in the outer circumferential portion of the pore forming area of the plate 10 according to the film thickness distribution shown in FIG. 13 at step S211. The target porosity P may, however, be adjusted in any divisional area in the pore forming area of the plate 10 according to the distribution of plating film thickness on the substrate 402. The adjustment at step S211 may be performed, regardless of the presence or the absence of the paddle 412.

The series of processing from step S202 to step S214 determines the number of divisional areas Div, i.e., the number of the pores 12 arranged in the radial direction, the space Sr in the radial direction, and the number of the pores 12 arranged in the circumferential direction on the reference circle $Cref_k$ with respect to each divisional area. The manufacturing process subsequently determines the angle of arrangement of the pores 12 on each reference circle $Cref_k$. More specifically, the manufacturing process calculates an angle pitch $\theta_{pitch_k}$ of the pores 12 arranged in each divisional area $N_k$ and an initial angle $\theta_{int_k}$ (step S215). The angle pitch $\theta_{pitch_k}$ of the pores 12 is expressed as (360 degrees/the number of pores $Pr_k$ in each divisional area).

The following describes a method of calculating the initial angle $\delta_{int_k}$. According to the embodiment, the initial angle $\theta_{int_k}$ is an angle of a reference pore 12 relative to an arbitrary radius of the reference circle $Cref_k$. The plurality of pores 12 formed in the plate 10 are arranged on the reference circle at the angle pitch $\theta_{pitch_k}$ from this reference pore 12. According to the embodiment, an initial angle $\theta_{int_k}$ is calculated, such that the centers of three pores 12 respectively arranged on three adjacent reference circles $Cref_k$ are not aligned on an arbitrary radius. More specifically, the initial angle $\theta_{int_k}$ of pores 12 respectively arranged, for example, in a divisional area $N_k$ to a divisional area $N_{k+2}$ are calculated, such that the pores 12 arranged on reference circles $Cref_k$ to $Cref_{k+2}$ in the divisional areas $N_k$ to $N_{k+2}$ are not aligned on an identical radius. In the case of the elongated pore 12, the center of the oblong pore 12 is the position of the center of the circumference passing through the circular portions 121 and 122 at the respective ends of the oblong pore (the position that is equal distances from the centers of the circular portions at the respective ends).

According to the embodiment, as one example, it is assumed that an initial angle $\theta_1$ of a divisional area $N_1$ is equal to an angle pitch $\theta_{pitch_1}$, that an initial angle $\theta_2$ of a divisional area $N_2$ is equal to (angle pitch $\theta_{pitch_1}$+initial angle $\theta_1/2$), and that an initial angle $\theta_3$ of a divisional area $N_3$ is equal to (angle pitch $\theta_{pitch_1}$+(initial angle $\theta_1$+initial angle $\theta_2$)/2). Accordingly, an initial angle $\theta_i$ in an arbitrary divisional area $N_k$ is calculated by an expression given below:

$$\theta i = \theta \text{pitch_i} + \sum_{k=2}^{i} \theta(k-1)/2 \quad \text{[Math. 1]}$$

As another example, it is assumed that an initial angle $\theta_1$ of a divisional area $N_1$ is equal to an angle pitch $\theta_{pitch_1}$, that an initial angle $\theta_2$ of a divisional area $N_2$ is equal to an angle pitch $\theta_{pitch_2}$, that an initial angle $\theta_3$ of a divisional area $N_3$ is equal to (angle pitch $\theta_{pitch_3}$+(initial angle $\theta_1$+initial angle $\theta_2$)/2), that an initial angle $\theta_4$ of a divisional area $N_4$ is equal to an angle pitch $\theta_{pitch_4}$, and that an initial angle $\theta_5$ of a divisional area $N_5$ is equal to (angle pitch $\theta_{pitch_5}$+(initial angle $\theta_1$+initial angle $\theta_2$+initial angle $\theta_3$+initial angle $\theta_4$)/2). Accordingly, when i=2n (where n is an integral value of not less than 1), an initial angle $\theta_i$ in an arbitrary divisional area $N_k$ is calculated by an expression given below:

$$\theta i = \theta \text{pitch_}i \quad \text{[Math. 2]}$$

When i=2n+1, the initial angle $\theta_i$ in the arbitrary divisional area $N_k$ is calculated by an expression given below:

$$\theta i = \theta \text{pitch_i} + \sum_{k=2}^{i} \theta(k-1)/2 \quad \text{[Math. 3]}$$

The configuration of arranging the pores 12 on the reference circles $Cref_k$ in the respective divisional areas $N_k$ at the initial angle $\theta_{int_k}$ and the angle $\theta_{pitch_k}$ calculated in the two examples of calculation described above prevents the centers of the three pores 12 respectively arranged on the three adjacent reference circles $Cref_k$ from being aligned on an arbitrary radius. The above expressions of [Math. 1] to [Math. 3] are only illustrative, but a modification may employ an arbitrary initial angle $\theta_{int_k}$ that prevents the centers of the three pores 12 respectively arranged on the three adjacent reference circles $Cref_k$ from being aligned on an arbitrary radius. Another modification may calculate the initial angle $\theta_{int_k}$ according to a pattern of the pores 12 in each divisional area. More specifically, with respect to a divisional area where the oblong pores 12 are formed, the modification may calculate the initial angle $\theta_{int_k}$, such as to suppress an approach to the pores 12 in an adjacent divisional area 12 by a method other than those described in the above examples.

After calculating the initial angle $\theta_{int_k}$ and the angle pitch $\theta_{pitch_k}$ in each divisional area $N_k$, the manufacturing process forms the pores 12 sequentially from the divisional area $N_k$ on the center side of the plate 10, i.e., from the divisional area $N_1$, according to the parameters calculated by the processing of steps S202 to S215 (step S216).

As described above, the configuration of the embodiment elongates the pores in each divisional area, when the inter-pore space in the divisional area is less than the machinable minimum inter-pore space. This configuration solves the problem that it is difficult to machine the pores or that there is no drill having a diameter corresponding to the required pore diameter and causes the total pore area of the pores actually formed in each divisional area to be closer to or equal to the theoretical total pore area $S_{theo}$ calculated from the target porosity P. This makes the porosity of the actually formed pores closer to or equal to the target porosity. When it is determined that elongation of the pores is desirable, due to any reason, for example, the occurrence of the problem that there is no drill having a diameter corresponding to the required pore diameter by any cause other than that described above or the problem of machining cost, the elongation of the pores may be performed, irrespective of the results of determination at step S209 and step S213 in FIG. 5A and FIG. 5B.

The configuration of the embodiment enables the porosity in the plate 10 to be locally changed by adjusting the porosity $P_k$ in each divisional area $N_k$. This configuration improves the distribution of the plating film thickness on the substrate and improves the in-plane uniformity. Furthermore, the configuration of the embodiment adjusts the area radius R of the pore forming area of the plate 10 and optimizes the porosity in each divisional area of the pore forming area (as shown in, for example, FIG. 13), for the purpose of adjusting the film thickness in the outer circumferential portion of the substrate. This flattens the film thickness distribution of the entire substrate. When the inter-pore space becomes less than the machinable minimum inter-pore space by the adjustment of the porosity, the configuration of the embodiment elongates the pores and enables the elongated pores to be machined with a view to achieving the porosity after the adjustment.

The configuration of the embodiment prevents the centers of the three pores 12 respectively arranged on the three adjacent reference circles $Cref_k$ from being aligned on an arbitrary radius of the plate 10. This configuration suppresses the pores 12 from being densely arranged on any radius and thereby suppresses a local anisotropy in the distribution of the pores 12.

Moreover, the plurality of pores 12 are arranged at equal intervals along the circumferential direction on the reference circle $Cref_k$ in the plate 10. This configuration suppresses the pores 12 from being densely arranged on the reference circle $Cref_k$ and thereby suppresses a local anisotropy in the distribution of the pores 12.

Furthermore, the plate 10 has a fixed difference between the diameter of any reference circle $Cref_k$ and the diameter of an adjacent reference circle $Cref_{k+1}$, where the pores 12 are arranged. In other words, the pores 12 are arranged at equal intervals in the radial direction. This configuration accordingly suppresses the pores 12 from being densely arranged in the radial direction and thereby suppresses a local anisotropy in the distribution of the pores 12.

Some aspects of the present disclosure are described below.

According to a first aspect, there is provided a plate that is placed between a substrate and an anode in a plating tank. The plate comprises a pore forming area in which a plurality of pores are formed, wherein the pore forming area includes a center portion, a middle portion located on an outer side of the center portion, and an outer circumferential portion located on an outer side of the middle portion, the center portion and the outer circumferential portion of the pore forming area have a plurality of oblong pores, and the middle portion of the pore forming area has a plurality of circular pores. The pore forming area may be an entire surface of the plate or may be part of the plate. For example, there may be a region in which no pores are formed, outside of an outer periphery of the pore forming area.

The configuration of this aspect enables the porosity that is a distribution density of the pores to readily approach a desired target porosity in the center portion or in the outer circumferential portion of the pore forming area. For example, in the case of circular pores, the number of pores calculated from the target porosity may be a decimal, and it is required to determine the number of pores by processing the decimal to an integral number. Accordingly, the porosity determined by formation of the processed integral number of pores is likely to have an error from the target porosity, especially in the center portion having the less number of pores. In the configuration of increasing the number of pores and/or decreasing the pore diameter in order to make the porosity approach the target porosity, the inter-pore space that is the interval between adjacent pores is likely to become less than the machinable minimum inter-pore space. This results in a difficulty in machining the pores or results in no drill having a diameter corresponding to the required diameter. In such cases, elongation of the pores in the relevant portion to oblong pores causes the porosity of the pores formed in the relevant portion to approach the target porosity, while keeping the minimum inter-pore space.

In order to improve the in-plane uniformity of a plating film formed on the substrate, in some cases, it is preferable to change the target porosity in a specific part of the pore forming area to be different from the target porosity in the other part. Changing the pore diameter (and/or the number of pores) according to the target porosity after the change may, however cause the inter-pore space to become less than the minimum inter-pore space. Even in this case, elongation of the pores in the specific part to oblong pores causes the porosity of the pores formed in the specific part to approach the target porosity, while keeping the minimum inter-pore space.

There are reasons why formation of oblong pores achieves a desired distribution density with keeping the minimum inter-pore space. Unlike formation of the circular pores, formation of the oblong pores regulates the pore dimension in the circumferential direction of the plate to adjust the pore area with high accuracy, while suppressing/preventing a change in pore dimension in the radial direction of the plate and reducing an increase in the number of pores. When it is determined that elongating the pores to oblong pores is desirable rather than changing the pore diameter, due to any reason other than those described above (for example, the problem that there is no drill having a diameter corresponding to the required pore diameter or the problem of machining cost), the elongation of the pores may be performed. When it is determined that elongation of the pores is desirable by any reason irrespective of the requirement for changing the pore diameter, oblong pores may be formed instead of circular pores.

In the case of concentrical arrangement of pores, the middle portion tends to have a larger number of pores than that in the center portion and also tends to have a smaller error of the porosity caused by formation of the processed integral number of pores as described above, to be less than a predetermined value. The outer circumferential portion of the substrate tends to have a thicker plating film or a thinner plating film. In some cases, with a view to improving the in-plane uniformity of the plating film thickness, it is accordingly desired to change the pore diameter and adjust the target porosity in the outer circumferential portion of the pore forming area. Accordingly, the configuration of forming the oblong pores in the center portion and/or in the outer circumferential portion to achieve the desired target porosity and forming the more readily machinable circular pores in the middle portion further facilitates manufacture of the plate.

According to a second aspect, in the plate of the first aspect, part or all of the plurality of pores may be formed on circumferences of a plurality of circles that are concentrical. Pores on one or multiple adjacent circumferences including an innermost circumference may be oblong pores, and/or, pores on one or multiple adjacent circumferences including an outermost circumference may be oblong pores.

The configuration of this aspect forms the oblong pores on the innermost circumference and on one or multiple circumferences adjoining to the innermost circumference, which are significantly affected by processing the number of pores to an integral number as described above. This reduces an error caused by processing the number of pores to an integral number. The configuration of this aspect also forms the oblong pores on the outermost circumference and on one or multiple circumferences adjoining to the outermost circumference, which correspond to an outer circumferential portion of a substrate that tends to have non-uniform plating film. This enhances the flexibility in adjustment of the target porosity and improves the in-plane uniformity of the plating film on the substrate. In the center portion of the pore forming area, the oblong pores may be formed only on the innermost circumference. In the outer circumferential portion of the pore forming area, the oblong pores may be formed only on the outermost circumference.

According to a third aspect, in the plate of either the first aspect or the second aspect, a porosity that is a distribution density of pores in the outer circumferential portion may be different from porosities in the other portions.

The configuration of this aspect adjusts the target porosity in the outer circumferential portion of the pore forming area separately from the adjustment in the other portions. This configuration enables the plating film thickness to be locally adjusted on the outer circumferential portion of the substrate that tends to have the thicker plating film, and thereby improves the in-plane uniformity of the plating film thickness.

According to a fourth aspect, there is provided a plate that is placed between a substrate and an anode in a plating tank. The plate comprises a pore forming area in which a plurality of pores are formed, wherein a porosity that is a distribution density of pores in an outer circumferential portion of the pore forming area is different from a porosity in the other portion of the pore forming area, and the outer circumferential portion has oblong pores.

The configuration of this aspect enables the target porosity to be locally adjusted in a portion of the pore forming area of the plate corresponding to a portion having a non-uniform distribution of the plating film thickness on a substrate and thereby improves the in-plane uniformity of the plating film thickness. Adjusting the porosity by formation of oblong pores expands the range of adjustment of the porosity. For example, adjusting the target porosity in the outer circumferential portion of the pore forming area by formation of oblong pores enables the plating film thickness to be locally regulated with high accuracy in the outer circumferential portion of the substrate that tends to have the thinner plating film or the thicker plating film, and thereby improves the in-plane uniformity of the plating film thickness.

According to a fifth aspect, in the plate of the fourth aspect, a middle portion located on an inner side of the outer circumferential portion may have a plurality of circular pores, and a center portion located on an inner side of the middle portion may have a plurality of oblong pores.

The configuration of this aspect forms oblong pores in the center portion, which is significantly affected by processing the number of pores to an integral number as described above, while forming readily machinable circular pores in the middle portion. This configuration facilitates manufacture of the plat, while achieving a desired porosity.

According to a sixth aspect, in the plate of either the fourth aspect or the fifth aspect, the center portion and the middle portion may have identical porosities.

The configuration of this aspect causes the porosities in the center portion and the middle portion located on the inner side of the outer circumferential portion to be equal to each other. This improves the in-plane uniformity on the inner side of the outer circumferential portion of the substrate.

According to a seventh aspect, in the plate of any one of the first aspect to the sixth aspect, the oblong pore may have a longitudinal direction along a circumference and may include semicircular portions at respective ends thereof and an annular portion between the semicircular portions.

The configuration of this aspect forms the oblong pores by moving an end mill along the circumference in milling. The length/area of the oblong pores may be controlled by regulating the length of a trajectory in end milling. This configuration reduces an increase in the number of pores in the circumferential direction and adjusts the dimension of the pore in the circumferential direction, while reducing/preventing an increase in the dimension of the pore in the radial direction of the plate. This achieves a desired porosity, w % bile keeping the inter-pore dimension.

According to an eighth aspect, there is provided an apparatus for plating, comprising: the plate according to any one of the first aspect to the seventh aspect; and a plating tank in which the plate is placed. This aspect provides the apparatus for plating that has the functions and the advantageous effects described above with regard to the plate of any one of the above aspects and improves the in-plane uniformity of the plating film.

According to a ninth aspect, the apparatus for plating may further comprise a paddle that is placed between the substrate and the plate.

The configuration of this aspect forms a strong current of a plating solution on the surface of the substrate by stirring with the paddle and thereby improves the in-plane uniformity. Placing the paddle increases the distance between substrate and the plate and relieves the sensitivity of misalignment between the substrate and the plate. The outer circumferential portion of the substrate generally has concentration of the electric fields and tends to increase the film thickness. The configuration that the paddle is placed between the plate and the substrate increases the distance between the substrate and the plate and increases the dimensions of the plating tank in a planar direction, with a view to ensuring the space where the paddle is placed and the space where the paddle is moved. This increases the wraparound of the electric field to the outer circumferential portion of the substrate and makes the tendency of increasing the film thickness in the outer circumferential portion of the substrate more prominent. Even in such cases, using the plate described above enables the target porosity to be adjusted in the outer circumferential portion of the plate and improves the in-plane uniformity of the plating film on the substrate.

According to a tenth aspect, there is provided a method of manufacturing a plate that is placed between a substrate and an anode in a plating tank and that has a plurality of pores. This comprises determining an area radius that is a diameter of an area where the plurality of pores are formed in the plate, a pore diameter of the plurality of pores, and a target porosity in the area in the area radius; dividing the area into a plurality of divisional areas, which include a circular divisional area including a center of the area and annular divisional areas having a fixed width that is identical with a width of the circular divisional area, based on the area radius, the pore diameter and the target porosity; and forming the plurality of pores on reference circles that are respectively placed in the plurality of divisional areas in the plate, wherein oblong pores are formed on the reference circle in one or multiple divisional areas among the plurality of divisional areas.

The configuration of this aspect enables the porosity that is the distribution density of pores to readily approach a desired target porosity in each divisional area. In the divisional area which has a difficulty in achieving the target porosity by formation of circular pores, forming the oblong pores increases or decreases the dimension of the pore in the circumferential direction of the plate, while suppressing a change in the dimension of the pore in the radial direction of the plate. This configuration enables the pore area to be increased or decreased, while keeping the inter-pore space. This expands the adjustment range of the porosity in each divisional area.

According to an eleventh aspect, the method of manufacturing the plate of the tenth aspect may comprise a step of determining a number of pores in each divisional area by dividing a target total pore area, which is determined from an area of the divisional area and the target porosity, by an area of the pore corresponding to the pore diameter and by processing a result of division to an integral number; a step of determining whether an error between a total pore area calculated from the processed integral number of pores and the target total pore area is equal to or greater than a predetermined value, with regard to each divisional area, and increasing the number of pores and decreasing the pore diameter when the error is equal to or greater than the predetermined value; and a step of, when an inter-pore space in a divisional area becomes less than a machinable minimum inter-pore space of the pores as a result of changing the number of pores and the pore diameter, elongating the pores in the divisional area to oblong pores.

In the case of circular pores, increasing the number of pores and/or decreasing the pore diameter with a view to reducing an error of the porosity caused by the number of pores that is calculated from the target porosity and that is processed to an integral number, may cause the inter-pore space to become less than the minimum inter-pore space, as described above. This results in a difficulty in machining the pores. In such cases, forming the oblong pores enables the porosity to approach the target porosity, while keeping the minimum inter-pore space.

According to a twelfth aspect, the method of manufacturing the plate of either the tenth aspect or the eleventh aspect may comprise a step of changing the target porosity in at least part of the divisional areas and changing the pore diameter to achieve the changed target porosity; and a step of, when an inter-pore space in the divisional area becomes less than a machinable minimum inter-pore space of the pores as a result of changing the pore diameter, elongating the pores in the divisional area to oblong pores.

With a view to, for example, improving the in-plane uniformity of a plating film formed on the substrate, in some cases, it is preferable to change the target porosity in a specific part of the pore forming area to be different from the target porosity in the other part. Changing the number of pores and/or the pore diameter according to the target porosity after the change may, however cause the inter-pore space to become less than the minimum inter-pore space. Even in this case, the configuration of this aspect elongates the pores in the specific part to oblong pores. This causes the porosity of the pores formed in the specific part to approach the target porosity, while keeping the minimum inter-pore space.

According to a thirteenth aspect, in the method of manufacturing the plate of any one of the tenth aspect to the twelfth aspect, the inter-pore space may include an inter-pore space in a circumferential direction determined as a difference between the pore diameter and a result of division of a circumferential length of the reference circle by the number of pores, and an inter-pore space in a radial direction determined from a difference between radii of reference circles in adjacent divisional areas and the pore diameter. When at least one of the inter-pore space in the circumferential direction and the inter-pore space in the radial direction is less than the minimum inter-pore space in each divisional area, the pores in the divisional area may be elongated to oblong pores.

The configuration of this aspect elongates the pores to oblong pores, based on both the inter-pore space in the circumferential direction and the inter-pore space in the radial direction, with respect to each divisional area. This configuration keeps both the inter-pore space in the circumferential direction and the inter-pore space in the radial direction to be equal to or greater than the minimum inter-pore space.

According to a fourteenth aspect, the method of manufacturing the plate of any one of the tenth aspect to the twelfth aspect may comprise setting a reference circle to arrange the plurality of pores in each divisional area. The oblong pore may include semicircular portions at respective ends thereof and an annular portion between the semicircular portions, and the oblong pores may be formed by controlling a circumferential length of the reference circle between centers of the semicircular portions at the respective ends or a size of a center angle.

The configuration of this aspect readily controls the area of the oblong pores by, for example, moving a tip of a machining tool along the circumference of the reference circle. The configuration of this aspect also enables the area of the oblong pore to be calculated with high accuracy using the radius of the reference circle and the radius of the circular pore.

According to a fifteenth aspect, in the method of manufacturing the plate of any one of the tenth aspect to the fourteenth aspect, the oblong pore may be formed by milling, and an area of the oblong pore may be controlled by regulating a length of a trajectory of end milling.

The configuration of this aspect enables a desired oblong pore to be readily formed by end milling. The configuration of this aspect also enables the length/area of the oblong pore to be calculated from the radius of a tip in a circular shape of an end mill. This configuration accordingly enables the dimensions of the oblong pore corresponding to the target porosity to be set with high accuracy.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit respective constituent elements described in the claims and the specification in a range where at least a part of the above-mentioned problem can be solved or a range where at least a part of the effect is exhibited.

REFERENCE SIGNS LIST

Sc space in the circumferential direction
$Pr_k$ number of pores
$\theta_{int_k}$ initial angle
$Rref_k$ reference circle radius
$Cref_k$ reference circle
AP difference
$N_k$ divisional area
$D_{pore}$ pore diameter
P target porosity
Sr space in the radial direction
R area radius Div number of divisional areas
10 plate
400 plating module
401 plating tank
402 substrate
412 paddle

The invention claimed is:

1. A plate that is placed between a substrate and an anode in a plating tank, the plate comprising a pore forming area in which a plurality of pores are formed, wherein the pore forming area includes a center portion, a middle portion located on an outer side of the center portion, and an outer circumferential portion located on an outer side of the middle portion, the center portion and the outer circumferential portion of the pore forming area have a plurality of oblong pores, and the middle portion of the pore forming area has a plurality of circular pores.

2. The plate according to claim 1, wherein part or all of the plurality of pores are formed on circumferences of a plurality of circles that are concentrical, and pores on one or multiple adjacent circumferences including an innermost circumference are oblong pores, and/or, pores on one or multiple adjacent circumferences including an outermost circumference are oblong pores.

3. The plate according to claim 1, wherein a porosity that is a distribution density of pores in the outer circumferential portion is different from porosities in the other portions.

4. A plate that is placed between a substrate and an anode in a plating tank, the plate comprising a pore forming area in which a plurality of pores are formed, wherein a porosity that is a distribution density of pores in an outer circumferential portion of the pore forming area is different from a porosity in the other portion of the pore forming area, and the outer circumferential portion has oblong pores.

5. The plate according to claim 4, wherein a middle portion located on an inner side of the outer circumferential portion has a plurality of circular pores, and a center portion located on an inner side of the middle portion has a plurality of oblong pores.

6. The plate according to claim 4, wherein the center portion and the middle portion have identical porosities.

7. The plate according to claim 1, wherein the oblong pore has a longitudinal direction along a circumference and includes semicircular portions at respective ends thereof and an annular portion between the semicircular portions.

8. An apparatus for plating, comprising:

the plate according to claim 1; and a plating tank in which the plate is placed.

9. The apparatus for plating according to claim 8, further comprising:

a paddle that is placed between the substrate and the plate.

10. A method of manufacturing the plate according to claim 1, the method comprising:

determining an area radius that is a diameter of an area where the plurality of pores are formed in the plate, a pore diameter of the plurality of pores, and a target porosity in the area in the area radius;

dividing the area into a plurality of divisional areas, which include a circular divisional area including a center of the area and annular divisional areas wherein the center portion comprises the circular divisional area and zero or more annular divisional areas and wherein the middle portion and the outer circumferential portion each comprise one or more of the annular divisional areas not included in the center portion, the annular divisional areas having a fixed width that is identical with a width of the circular divisional area, based on the area radius, the pore diameter and the target porosity; and forming the plurality of pores on reference circles that are respectively placed in the plurality of divisional areas in the plate, wherein oblong pores are formed on the reference circle in multiple divisional areas among the plurality of divisional areas.

11. The method of manufacturing the plate according to claim 10, the method comprising:

a step of determining a number of pores in each divisional area by dividing a target total pore area, which is determined from an area of the divisional area and the target porosity, by an area of the pore corresponding to the pore diameter and by processing a result of division to an integral number;

a step of determining whether an error between a total pore area calculated from the processed integral number of pores and the target total pore area is equal to or greater than a predetermined value, with regard to each divisional area, and increasing the number of pores and decreasing the pore diameter when the error is equal to or greater than the predetermined value; and a step of, when an inter-pore space in a divisional area becomes less than a machinable minimum inter-pore space of the pores as a result of changing the number of pores and the pore diameter, elongating the pores in the divisional area to oblong pores.

12. The method of manufacturing the plate according to claim 10, the method comprising:

a step of changing the target porosity in at least part of the divisional areas and changing the pore diameter to achieve the changed target porosity; and a step of, when an inter-pore space in the divisional area becomes less than a machinable minimum inter-pore space of the pores as a result of changing the pore diameter, elongating the pores in the divisional area to oblong pores.

13. The method of manufacturing the plate according to claim 10, wherein the inter-pore space includes an inter-pore space in a circumferential direction determined as a difference between the pore diameter and a result of division of a circumferential length of the reference circle by the number of pores, and an inter-pore space in a radial direction determined from a difference between radii of reference circles in adjacent divisional areas and the pore diameter, and when at least one of the inter-pore space in the circumferential direction and the inter-pore space in the radial direction is less than the minimum inter-pore space in each divisional area, the pores in the divisional area are elongated to oblong pores.

14. The method of manufacturing the plate according to claim 10, wherein the oblong pore includes semicircular portions at respective ends thereof and an annular portion between the semicircular portions, and the oblong pores are formed by controlling a circumferential length of the reference circle between centers of the semicircular portions at the respective ends or a size of a center angle.

15. The method of manufacturing the plate according to claim 10, wherein the oblong pore is formed by milling, and an area of the oblong pore is controlled by regulating a length of a trajectory of end milling.

* * * * *